US006375490B1

(12) United States Patent
Yao

(10) Patent No.: US 6,375,490 B1
(45) Date of Patent: Apr. 23, 2002

(54) CONVENIENTLY ORIENTED RECEPTACLE FOR USE IN ELONGATED RACEWAYS

(75) Inventor: Kelvin Yao, Edison, NJ (US)

(73) Assignee: The Wiremold Company, West Hartford, CT (US)

( * ) Notice: Subject to any disclaimer, the term of this patent is extended or adjusted under 35 U.S.C. 154(b) by 0 days.

(21) Appl. No.: 09/375,982

(22) Filed: Aug. 16, 1999

(51) Int. Cl.[7] ..... H01R 4/24

(52) U.S. Cl. ..... 439/417; 439/209; 439/211; 439/685

(58) Field of Search ..... 439/417, 211, 439/209, 404, 208

(56) References Cited

U.S. PATENT DOCUMENTS 3,218,596 A * 11/1965 Oehlerking et al. ..... 439/107
4,017,137 A * 4/1977 Parks ..... 439/211
4,646,211 A * 2/1987 Gallant et al. ..... 439/209
4,872,849 A * 10/1989 Long ..... 439/405

* cited by examiner

*Primary Examiner*—P. Austin Bradley
*Assistant Examiner*—Briggette R. Hammond
(74) *Attorney, Agent, or Firm*—McCormick, Paulding & Huber LLP

(57) ABSTRACT

A receptacle for an elongated electrical raceway is oriented so that its ground receptacle lies either above or below the raceway's longitudinal centerline, presenting a convenient orientation for the plug, that is not commonly provided for in a raceway environment. The receptacle employs insulation displacement connectors offset so as to connect electrical wires running longitudinally through a raceway channel to the line and neutral and ground sockets at the receptacle's face.

8 Claims, 4 Drawing Sheets

CONVENIENTLY ORIENTED RECEPTACLE FOR USE IN ELONGATED RACEWAYS

BACKGROUND OF THE INVENTION

1. Field of the Invention

This invention relates generally to elongated electrical raceways and female receptacle assemblies for use therewith.

2. Description of the Prior Art

Electrical raceways having one or more female receptacles at their face are well known. In the prior art embodiments the female electrical receptacle is oriented at 90° from a traditional receptacle orientation so that the female ground stud opening lies on the raceway's longitudinal centerline. See U.S. Pat. No. 4,017,137 for an illustration of such a prior art construction.

Female receptacles employing insulation displacement connectors (IDCs) are known. The IDCs in the prior art are used to connect a prior art female receptacle with the electrical wires oriented along the longitudinal centerline of the raceway. The inherent result of such construction is a receptacle face rotated 90° as compared to traditionally mounted receptacles. This orientation of receptacles in raceways is so well established that it now constitutes 'conventional' orientation for elongated raceways.

The purpose of this invention is to provide female electrical receptacles in an elongated raceway or elongated power outlet bar such that the ground connector does not lie along the raceway longitudinal centerline. In typical raceways of which most are installed horizontally, the receptacle orientation requires that the male plug be turned 90° to insert it into the receptacle. Typical raceway through-wiring designs have dictated this odd orientation, where the line and neutral slotted connectors run parallel with the raceway longitudinal axis and their ground connector lies along the raceway longitudinal centerline. The present invention provides for receptacle orientation where the line and neutral slotted receptacles run perpendicular to the raceway centerline and the ground receptacle is either above or below the raceway centerline.

SUMMARY OF THE INVENTION

In accordance with the present invention an elongated raceway is provided with openings that receives female electrical receptacles. Each receptacle has a housing having a base and a cap arranged so that when assembled with electrical connectors and the elongated conductors or wires within the raceway channel, the resulting assembly presents the female receptacle to the user in a more familiar and more convenient to use manner. Electrical connectors are arranged and supported between the housing base and cap. Each connector has a free and a fixed end. The free end defines an insulation displacement connector (IDC) that connects to the conductive wire. The fixed end defines a resiliently deformable socket at the face of the housing cap. Three such sockets are accessible through openings at the face of the housing cap to receive a conventional male plug. The IDC ends are arranged in parallel planes, which are additionally parallel to the blades of the male plug that is to be received at the face of the housing cap.

The above arrangement provides a female receptacle for use in an elongated raceway that is oriented in a more convenient to use manner. The ground stud opening can be provided either above or below the line and neutral slots. The purpose of this invention is to provide this convenient orientation of the female receptacle while facilitating through wiring assembly of the raceway and receptacle with the through wiring in the raceway channel.

DETAILED DESCRIPTION

Figure 1:
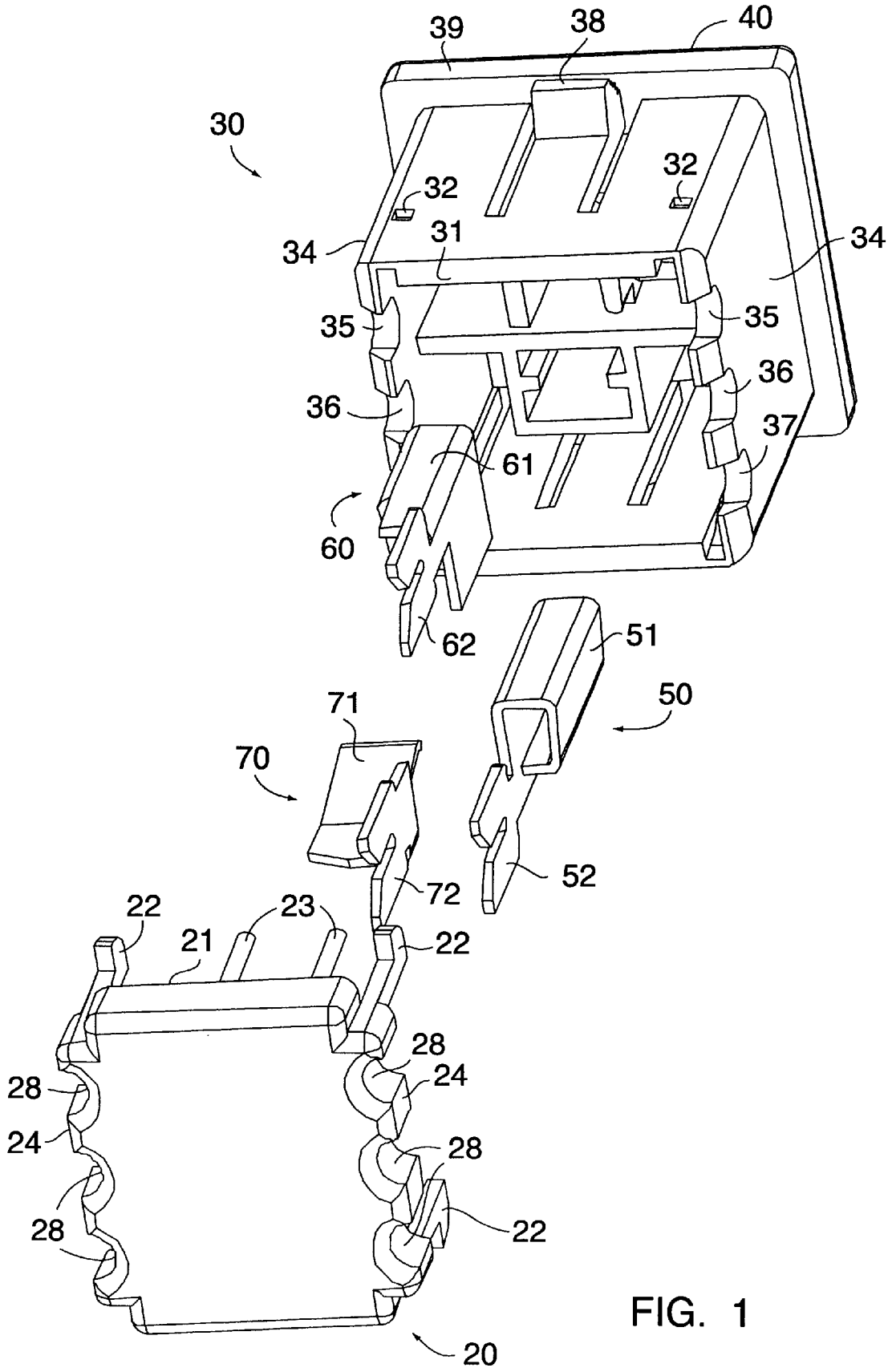
FIG. 1 is an exploded view illustrating the receptacle housing cap, base and exposed electrical connectors.

Turning now to the drawings in greater detail, FIG. 1 shows a molded hollow housing base 20 of the type having a generally rectangular forwardly open cavity. Said base incorporates a confronting interface 21 that abuts a complementary interface 31 on a housing cap 30. The housing base incorporates resiliently deformable posts 22 for alignment with slots or receptacles in the cap 30 for securing the base to said housing cap. The housing base incorporates molded connector aligning ribs 23 for receiving electrical connectors mounted in the housing cap and later described herein. At least one of the housing base sidewalls 24 incorporates a line groove 25, a neutral groove 26 and a ground groove 27 for receiving conductor wires that run parallel to the longitudinal center line of a raceway channel. Said grooves are defined by the sidewall confronting interface 21 such that the conductor wires are received therein. Opposed sidewalls of the housing base incorporate said grooves, opposing grooves are similarly defined by the confronting interface of the opposing sidewall to constitute pairs of grooves such that conductor wires passing straight through one pair of grooves run parallel to the raceway longitudinal center line. The housing base 20 preferably incorporates one or more molded channels 28 along the sidewalls 24 incorporating said grooves that serve to position that portion of a conductive wire outside the housing base parallel to said sidewall 24 and in alignment with the aforementioned grooves. These molded channels 28 are incorporated to complement the grooves defined by the housing base interface.

Figure 7:
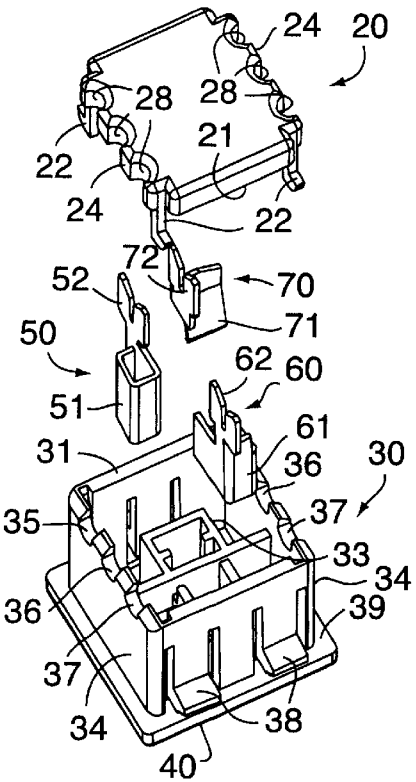
FIG. 7 is an exploded perspective view showing the electrical connector orientation.

A molded hollow housing cap 30 is provided of the type having a generally rectangular rearwardly open cavity. Said cap incorporates a confronting interface 31 that abuts the complementary interface on the housing base 21. The housing cap incorporates post receptacles 32 for receiving and securing to complementary deformable posts 22 within the housing base 20. The housing cap 30 incorporates molded connector supporting ribs 33, shown in FIG. 7, for receiving and supporting electrical connectors later described herein. The housing cap sidewalls 34 incorporate channels or grooves, such as a line groove 35, neutral groove 36, ground groove 37, for receiving conductor wires that run parallel to the longitudinal center line of a raceway channel. Said grooves are defined by the sidewall confronting interface 31 such that a conductive wire may be received laterally. The opposing grooves are similarly defined by the confronting interface of the opposing sidewall to constitute pairs of grooves such that a conductive wire passing straight through one pair of grooves runs parallel to the raceway longitudinal center line.

Figure 11:
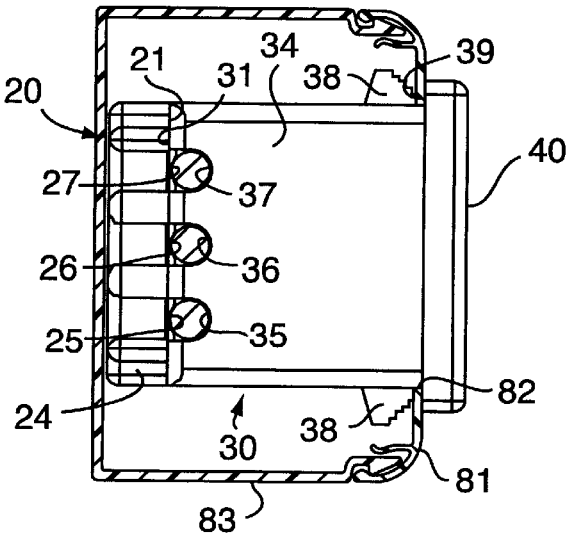
FIG. 11 is a sectional view taken on the line 11—11 of FIG. 10.

The housing cap 30 incorporates molded resilient wings 38 along each sidewall. Preferably two said wings are provided on one of the sidewalls. Two such wings are shown along the bottom sidewall adjacent the ground stud opening and one such wing along the opposing top sidewall. A flange 39 extends peripherally around the housing cap 30 and cooperates with the wings to anchor the housing in a raceway opening 82 of a raceway having a cover 81 and a raceway base 83 (See FIG. 11). The resilient wings 38 allow the female receptacle to be inserted into the raceway opening 82. The wings 38 and flange 39 act in concert to prevent extraction of the device from the raceway.

Figure 2:
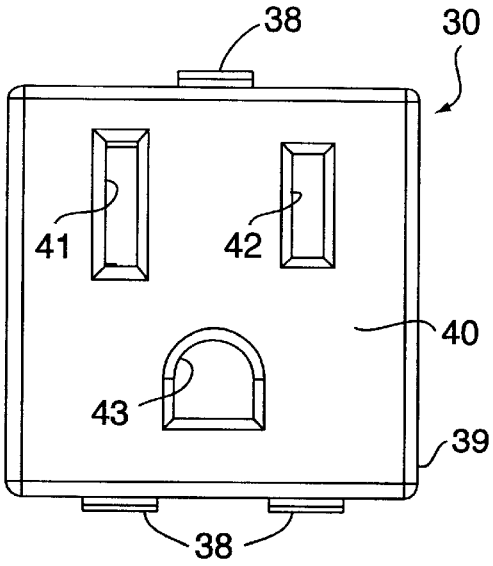
FIG. 2 illustrates the receptacle's plug face.
Figure 3:
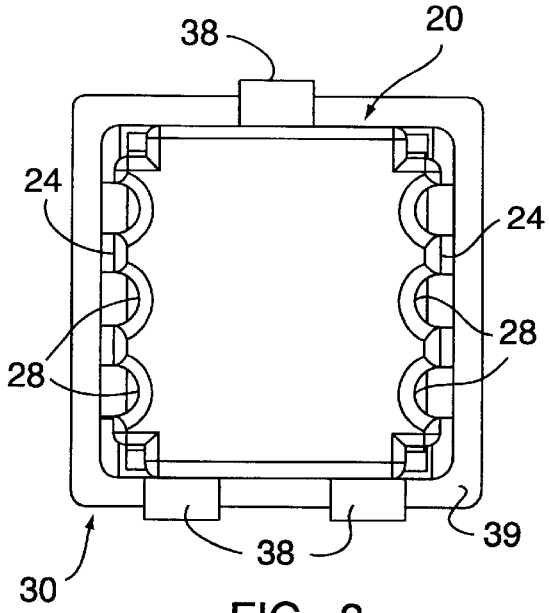
FIG. 3 illustrates the rear of the receptacle.
Figure 4:
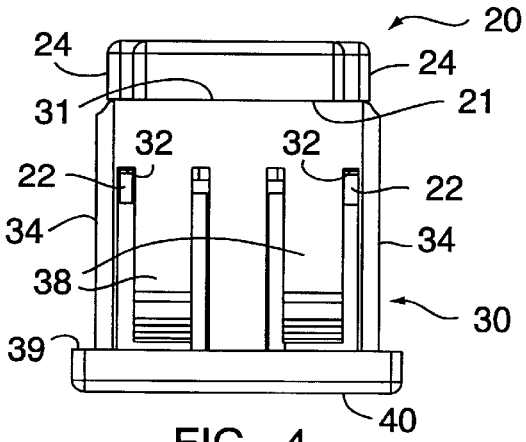
FIG. 4 illustrates the sidewall nearest the ground stud opening.
Figure 6:
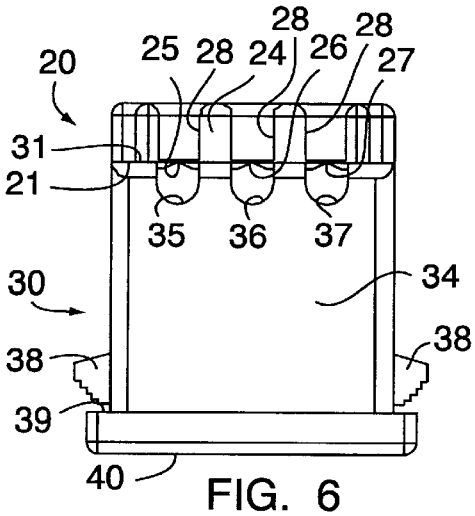
FIG. 6 illustrates the side view of the receptacle.
Figure 5:
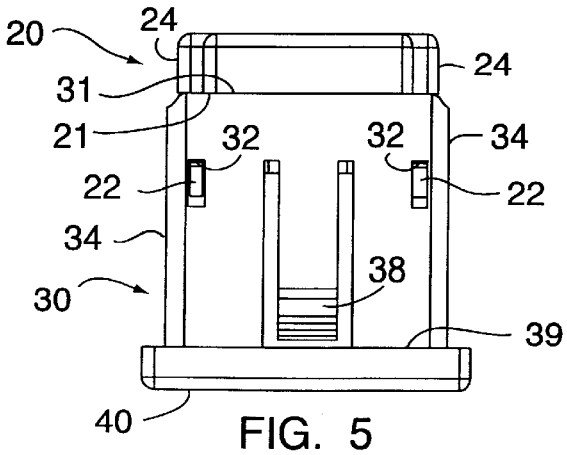
FIG. 5 illustrates the sidewall opposite the ground stud opening.
Figure 10:
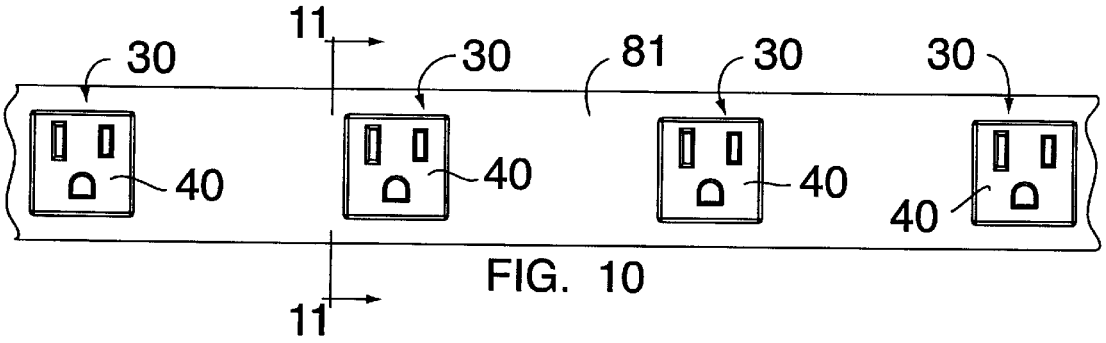
FIG. 10 shows the frontal view of the conveniently oriented receptacle mounted within a raceway.

The housing face 40 (FIG. 2) or forward end of the housing cap incorporates a female electrical receptacle having a line slot 41 and a parallel neutral slot 42 for receiving the blades of a conventional male plug, and a ground stud opening 43 for receiving the ground stud of a conventional male plug. The line slot 41 is preferably configured as a 15 ampere slot as shown in FIGS. 2 and 10, but may optionally be a 20 ampere 'T-shaped' slot not specifically illustrated herein, but considered an equivalent. Said receptacle is dimensioned to receive a male plug complying with U.S. standards or alternatively complying with the standards of any other country.

The housing cap 30 is provided with integrally molded connector supporting ribs 33 that cooperate with the ribs 23 in the base 20 to receive the electrical connectors for the line 50, neutral 60, and ground 70 conductors. Each connector has a fixed end in the housing cap 30 and a free end in the housing base 20. Said fixed ends each define a resiliently deformable socket for receiving a blade or ground stud from a conventional male plug through openings in the housing face 40. Said free ends each define an insulation displacement connector (IDC) with opposing cutting knife edges capable of penetrating the wire insulation of the conductors to electrically contact the underlying conductive wire without severing said underlying wire.

Each connector's free end is interposed and aligned with the pairs of grooves in the confronting interfaces of opposing sidewalls previously described, such that when the housing cap 30 and base 20 are assembled a conductive wire passing straight through aligned grooves (35, 36, or 37) in the base and (25, 26 and 27) in the cap will also be in electrical contact with the aligned IDC at the free end of an electrical connector. Thus, these electrical connectors secure the conductive wires running longitudinally through a raceway and electrically connect them to the sockets behind the plug face.

The line or power conductive wire passes through the groove 35 in the housing sidewall 34, through the IDC free end 52 of the line connector 50, and through the opposing groove 35 in the opposing housing sidewall 34. The opposing fixed end 51 of the line connector defines a resiliently deformable socket behind the line slot 41 at the housing face 40.

The neutral conductive wire passes through the neutral groove 36 in the housing sidewall 34, through the IDC end 62 of the line connector 60, and through the opposing neutral groove 36 in the opposing housing sidewall 34. The opposing fixed end 61 of the neutral connector defines a resiliently deformable socket behind the neutral slot 42 at the housing face 40. In the preferred embodiment the neutral conductive wire is preferably positioned between the line and ground conductive wires.

The ground conductive wire passes through the ground groove 37 in the housing sidewall 34, through the IDC end 72 of the ground connector 70, and through the opposing ground groove 37 in the opposing housing sidewall 34. The opposing fixed end 71 of the ground connector defines a resiliently deformable socket behind the ground stud opening 43 at the housing face 40.

Figure 9:
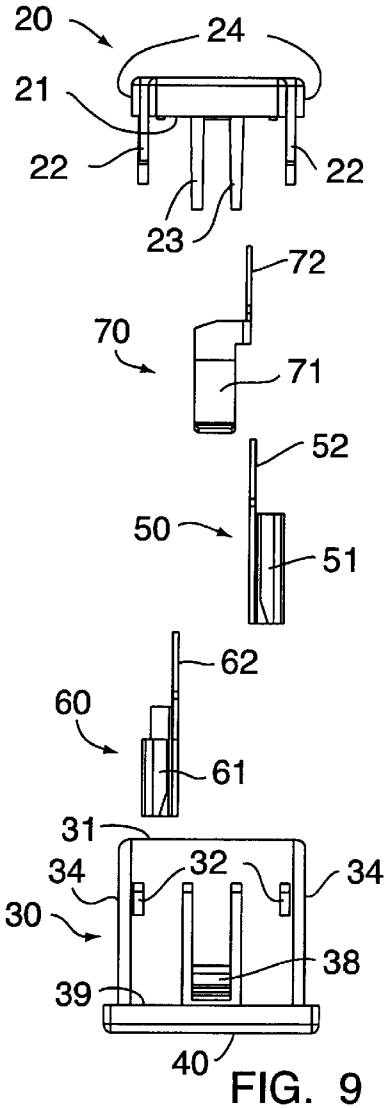
FIG. 9 is similar to FIG. 7 in top view.
Figure 8:
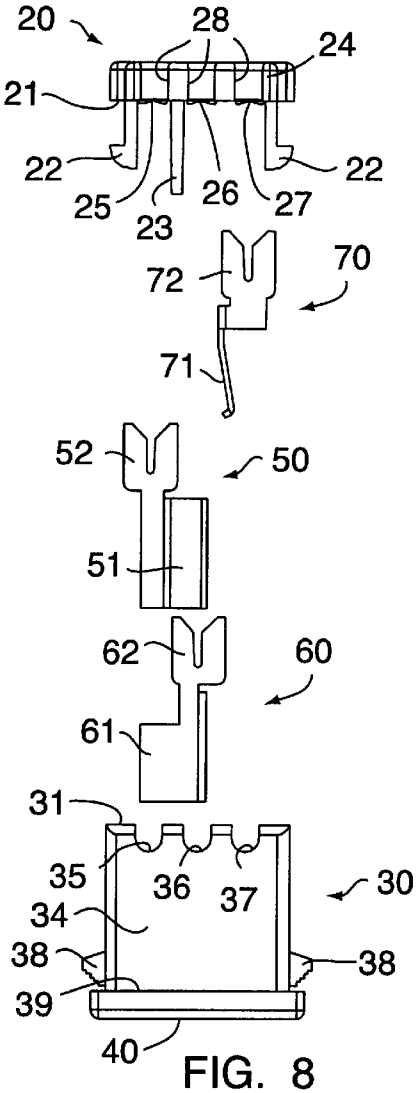
FIG. 8 is similar to FIG. 7 in plan view.

The configuration and orientation of the electrical connectors (50, 60, and 70) within the housing is of significance. As the preferred embodiment illustrates, each connector's IDC free end (52, 62, and 72) is oriented in a separate parallel plane, said planes also being parallel to the line 41 and neutral slots 42 at the housing face 40. Each electrical connector has its fixed end (51, 61, and 71) defining a resiliently deformable socket behind the housing face 40, as shown in detail at FIGS. 7, 8, and 9. Each male plug prong is received by one such resiliently deformable socket so defined by said fixed end of each electrical connector so that the male plug blades are oriented parallel to and spaced laterally from the plane defined by each IDC free end of said electrical connectors.

Modifications and variations of the above described embodiment will be apparent to those skilled in the art consistent with the teaching of this disclosure. The scope of the following claims encompasses such modifications and variations in accordance with the Doctrine of Equivalents.

I claim:

1. An electrical raceway assembly comprising:

an elongated channel-shaped raceway base, and a cover fitted onto said base, said cover having longitudinally spaced generally rectangular openings defined in a front face thereof;

elongated conductors within said channel-shaped base behind said openings;

a female receptacle in at least one of said openings, said receptacle having a base and a cap, said cap having a flange for engaging said cover front face and resilient wings for retaining said cap in said one cover opening, said receptacle base and cap defining a housing having confronting interfaces constructed and arranged on said base and cap as to trap the elongated conductors between said interfaces, electrical connectors inside said housing, said connectors having socket defining ends for driving parallel blades of a conventional male plug, and said electrical connectors having planar insulation displacement connector (IC) ends having opposing cutting knife edges defined at opposite ends of connectors relative to said socket defining ends, said socket defining ends cooperating with parallel slots in said cap to receive the blades of the male plug, and said planar IDC ends of said connectors being arranged substantially parallel to said slots in said cap, and said IDC ends and slots oriented perpendicular to the longitudinal orientation of the raceway assembly and the conductors therein.

2. The electrical raceway assembly of claim 1 wherein said cap has a polygon shape with said flange, and said resilient wings are defined by opposite sides of said polygon shape cap for cooperating with said flange to support said housing in a polygon-shaped opening in the raceway.

3. The electrical raceway assembly of claim 2 further comprising a third electrical connector inside said housing, said third electrical connector having a ground stud contactor end cooperating with a ground stud opening through said cap, and having an insulation displacing connector (IDC) end opposite said contactor end, said IDC end of said third electrical contactor not positioned between the IDC ends of the electrical connectors that receive the blades of a male plug when viewed along ad elongated conductors in said raceway assembly.

4. The electrical raceway assembly of claim 2 wherein said cap is rearwardly open for receiving resiliently deformable posts on said base, said posts having projecting end portions received in post receptacles provided in said cap.

5. The electrical raceway assembly of claim 4 wherein said cap and base of said housing define internal complementary rib portions for locating and supporting said electrical connectors inside said housing.

6. The electrical raceway assembly of claim 5 wherein said electrical connectors are provided in said cap prior to assembly of said cap base with the conductors.

7. The electrical raceway assembly of claim 5 wherein said cap has side walls, and wherein said post receptacles are defined in said side walk, and said side walls also defining said resilient wings, said side walls further defining said confronting interface of said cap and said cap interface defined by locating grooves provided in part on said cap and on said base for aligning the conductors with the IDC ends of said electrical connectors.

8. The electrical raceway assembly of claim 7 wherein said grooves are defined by the sidewall confronting interface of said base.

* * * * *

UNITED STATES PATENT AND TRADEMARK OFFICE

CERTIFICATE OF CORRECTION

PATENT NO. : 6,375,490 B1
DATED : April 23, 2002
INVENTOR(S) : Kelvin Yao

It is certified that error appears in the above-identified patent and that said Letters Patent is hereby corrected as shown below:

Column 4,
Line 53, please delete "driving" and insert -- receiving --.
Line 56, please delete "(IC)" and insert -- (IDC) --.

Column 5,
Line 11, please delete "ad" and insert -- (said) --.

Signed and Sealed this

Eighth Day of October, 2002

*Attest:*

*Attesting Officer*

JAMES E. ROGAN
*Director of the United States Patent and Trademark Office*